US005749552A

United States Patent [19]

Fan

[11] Patent Number: 5,749,552

[45] Date of Patent: May 12, 1998

[54] SHOWER HEAD MOUNTING ASSEMBLY

[76] Inventor: Chen-tung Fan, Room F/23, 4th Fl., No. 5, Sec. 5, Hsinyi Rd., Taipei, Taiwan

[21] Appl. No.: 643,480

[22] Filed: May 6, 1996

[51] Int. Cl.[6] ..... A47G 29/00; A47K 3/22

[52] U.S. Cl. ..... 248/205.8; 4/601; 4/605

[58] Field of Search ..... 248/205.1, 205.5, 248/205.8; 4/596, 601, 605

[56] References Cited

U.S. PATENT DOCUMENTS 3,375,532 4/1968 Gellmann ..... 4/601

3,982,285 9/1976 Roberts, Jr. ..... 4/605

*Primary Examiner*—Michael Safavi

*Attorney, Agent, or Firm*—Thomas, Kayden, Horstemeyer & Risley

[57] ABSTRACT

A mounting assembly for mounting a bracket for attaching a hand-held shower head in relation to a wall of a bathroom, includes a fitting having an end for connecting with a fixed spray head, another end for connecting a water supply pipe and an extending portion for threadedly engaging a top end of a post on which the bracket can be slideably locked therealong. A bottom end of the post is attached with a vacuum mounting assembly for mounting the bottom end of the post on the wall by a vacuum pressure.

3 Claims, 6 Drawing Sheets

SHOWER HEAD MOUNTING ASSEMBLY

FIELD OF THE INVENTION

The present invention is related to an improved mounting assembly for mounting a shower head, particularly for mounting a bracket for attaching a hand-held shower head.

BACKGROUND OF THE INVENTION

A modern bathroom is often equipped with a shower attachment. FIGS. 5 and 6 show a conventional shower attachment 10 which comprises a fixed spray head 12 and a hand-held shower head 18. The fixed spray head 12 is fixedly connected to a water supply pipe 16 via a fitting 17 wherein the water supply pipe 16 is fixedly encased in a wall 14 of the bathroom. The hand-held shower head 18 is connected to the water supply pipe 16 through a flexible hose 20 so that a user can move the shower head 18 to a desired position. Furthermore, the hand-held shower head 18 can be put on a bracket 22 to be attached thereon. The bracket 22 can be slideably locked along a post 26 by manipulating a knob 24 (FIG. 6) which is used to control a locking and unlocking between the bracket 22 and the post 26.

The post 26 has a top and bottom end which are respectively attached to the wall 14 by an upper mounting assembly 30 and a lower mounting assembly which is identical to the upper one. Thus, only the upper mounting assembly 30 will be explained below. Furthermore, for simplicity of the drawings, only the detailed structure of the upper mounting assembly 30 is shown.

The upper mounting assembly 30 includes two recesses 31 (only one being shown) having been drilled in the wall 14, two plastic plugs 32 (only one being shown) forcedly inserted into the holes 31, a mounting plate 33 fixedly attached on a surface of the wall 14 by extending two screws 34 (only one being shown) through two holes 334 (only one being shown) defined in the mounting plate 33 to threadedly engage with the plugs 32 in the wall 14, a screw 36 being extended through a hole 262 defined in a top end of the post 26 and threadedly engaged with a protrusion 332 of the mounting plate 33 thereby to fixedly attach the post 26 to the mounting plate 33, a cap 35 which is fixedly attached on the top end of the post 26 being used to hide the mounting plate 33 from sight when the post 26 is fixedly attached to the mounting plate 33, and a cover 37 being used to cover an opening end of the cap 35.

The above mentioned conventional mounting assembly 30 for mounting the post 26 on the wall 14 needs a lot of components. Furthermore, to attach the mounting assembly 30 on the wall 14 involves a number of laborious operations. Thus, to use the conventional mounting assembly 30 to mount the post 26 on the wall 14 incurs a high cost. More importantly, to use the conventional mounting assembly 30 to mount the post 26 on the wall 14 needs to practice a drilling operation on the wall 14, which will cause a permanent damage to the wall 14 of the bathroom.

The present invention therefore is aimed to provide an improved shower head mounting assembly to mitigate and/or obviate the aforementioned problems.

SUMMARY OF THE INVENTION

One object of the present invention is to provide a mounting assembly for mounting a post on which a bracket for attaching a hand-held shower head can be slideably locked therealong, wherein the mounting assembly consists of only a few components.

Another object of the present invention is to provide a mounting assembly for mounting a post on which a bracket for attaching a hand-held shower head can be slideably locked therealong, wherein to use the mounting assembly to mount the post on a wall of a bathroom is very easy and convenient.

A further object of the present invention is to provide a mounting assembly for mounting a post on which a bracket for attaching a hand-held shower head can be slideably locked therealong, wherein to use the mounting assembly to mount the post on a wall of a bathroom does not need a drilling operation on the wall.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
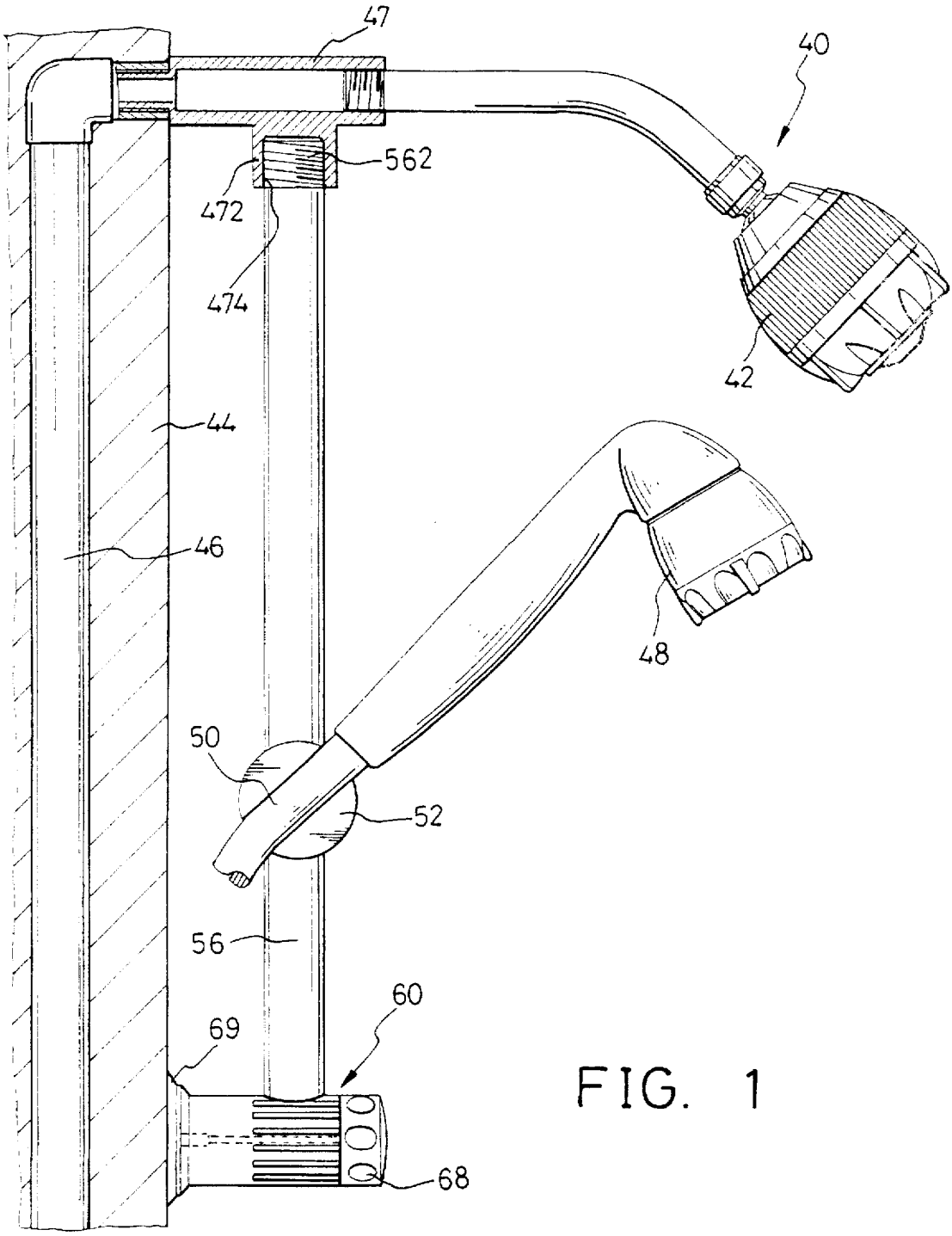
FIG. 1 is an elevational view, partly in cross-section, showing a shower attachment in accordance with the present invention.
Figure 2:
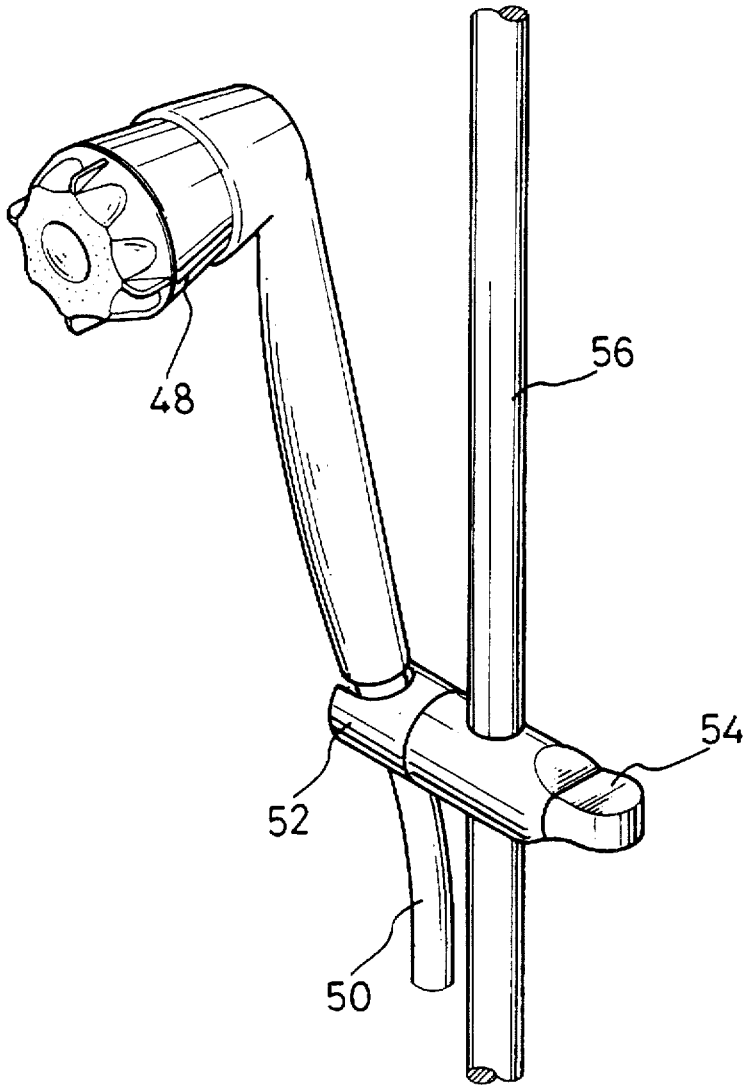
FIG. 2 is a perspective view, as seen substantially from a right and rear side of FIG. 1, showing the details of a bracket for receiving a hand-held shower head wherein the bracket is slideably locked on a post in accordance with the present invention.

Referring to FIGS. 1 and 2, a shower attachment in accordance with the present invention is generally indicated by reference number 40. The shower attachment 40 is mounted on a wall 44 of a bathroom. Like the conventional shower attachment 10 as disclosed by FIG. 5, the present shower attachment 40 also includes a fixed spray head 42 which is fixedly connected to a water supply pipe 46 via a fitting 47, wherein the pipe 46 is encased in the wall 44.

A hand-held shower head 48 is connected to the pipe 46 through a flexible hose 50. The hand-held shower head 48 can be put on a bracket 52 to be attached thereon. The bracket 52 can be slideably locked along a post 56 by manipulating a knob 54 (FIG. 2) which is used to control a locking and unlocking between the bracket 52 and the post 56.

Figure 5:
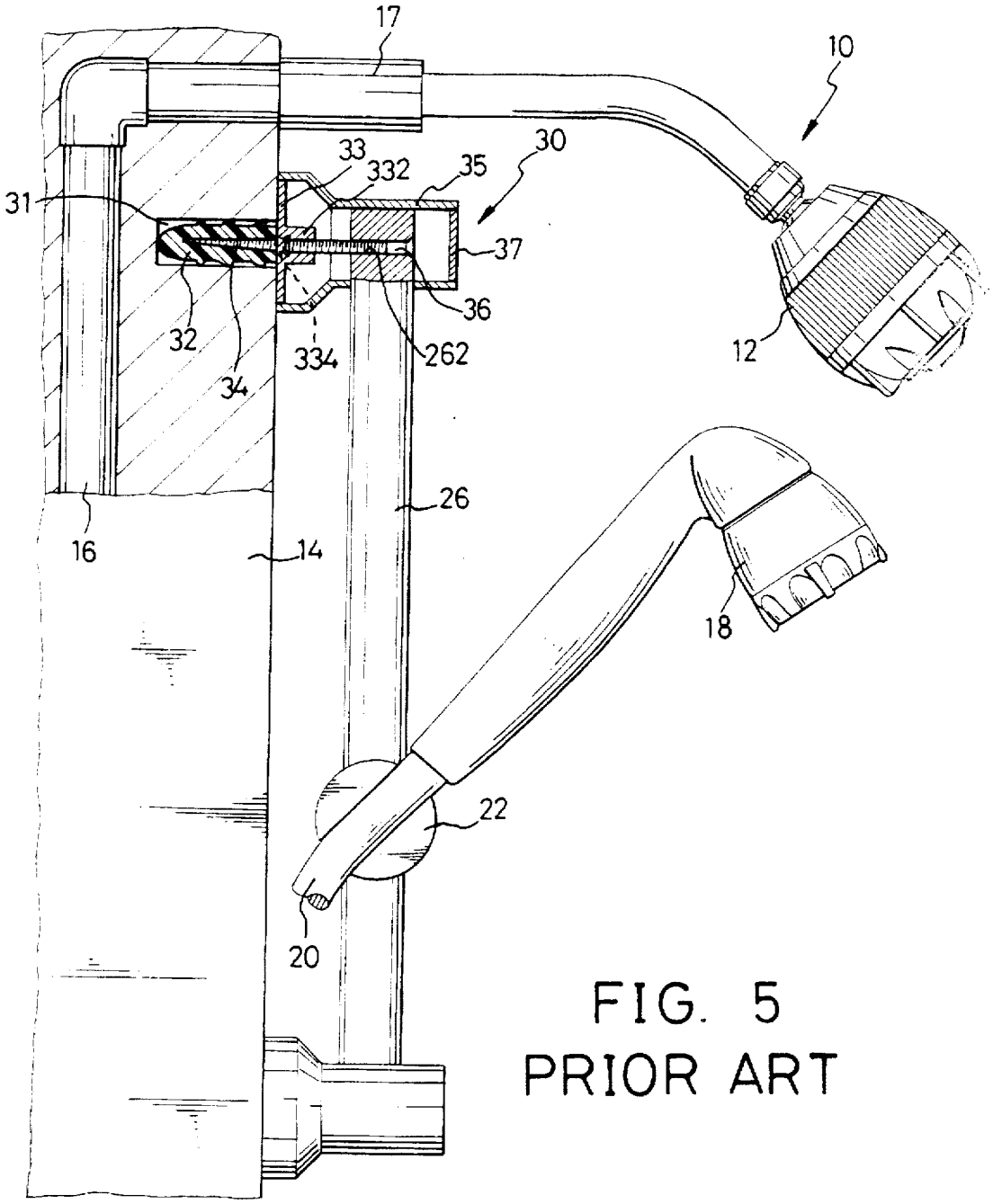
FIG. 5 PRIOR ART
FIG. 5 is a view similar to FIG. 1, but showing a prior art shower attachment.
Figure 6:
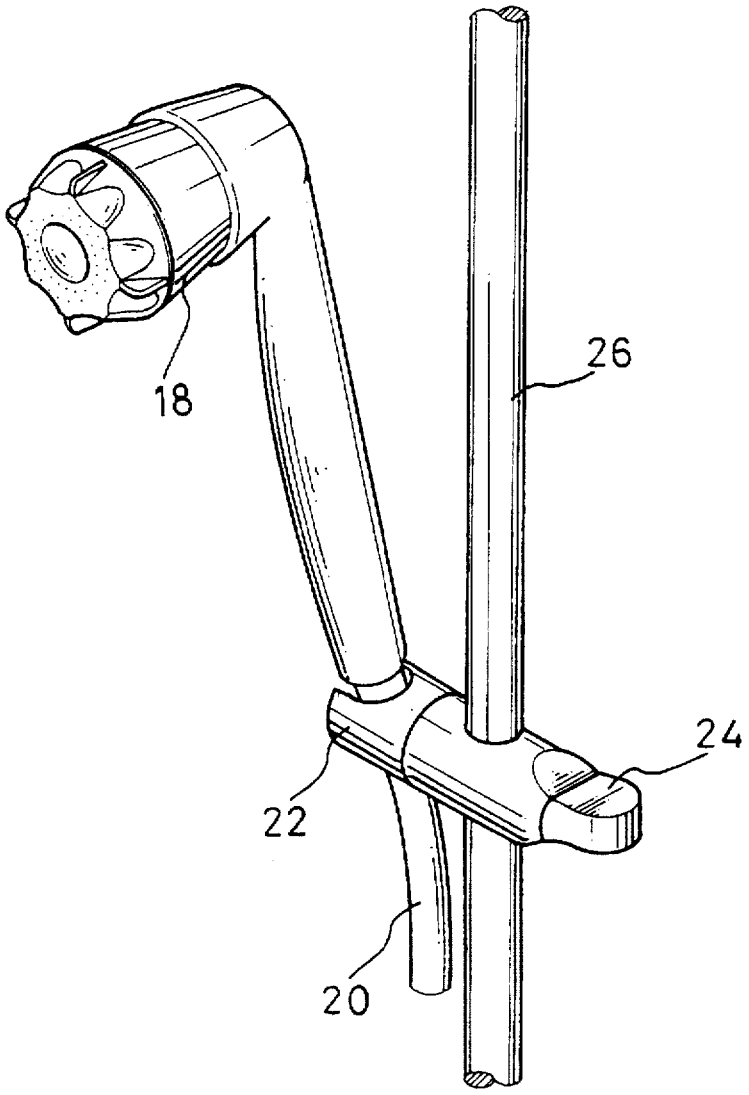
FIG. 6 PRIOR ART
FIG. 6 is a perspective view, as seen substantially from a right and rear side of FIG. 5, showing the details of a bracket for receiving a hand-held shower head wherein the bracket is slideably locked on a post in accordance with the prior art.

Unlike the conventional fitting 17 as shown in FIG. 5, the fitting 47 of the present invention is integrally formed with a radially extending portion 472 defining a recess 474 therein. The recess 474 defines a periphery having thread thereon. A periphery of a top end of the post 56 is provided with thread 562 which is used to threadedly engage the recess 474 of the radially extending portion 472 of the fitting 47, when the post 56 is intended to be mounted in the bathroom.

A bottom end of the post 56 is attached with a vacuum mounting device 60 which can mount a bottom end of the post on the wall 44 and will be explained in greater detail in reference to FIG. 3.

Figure 3:
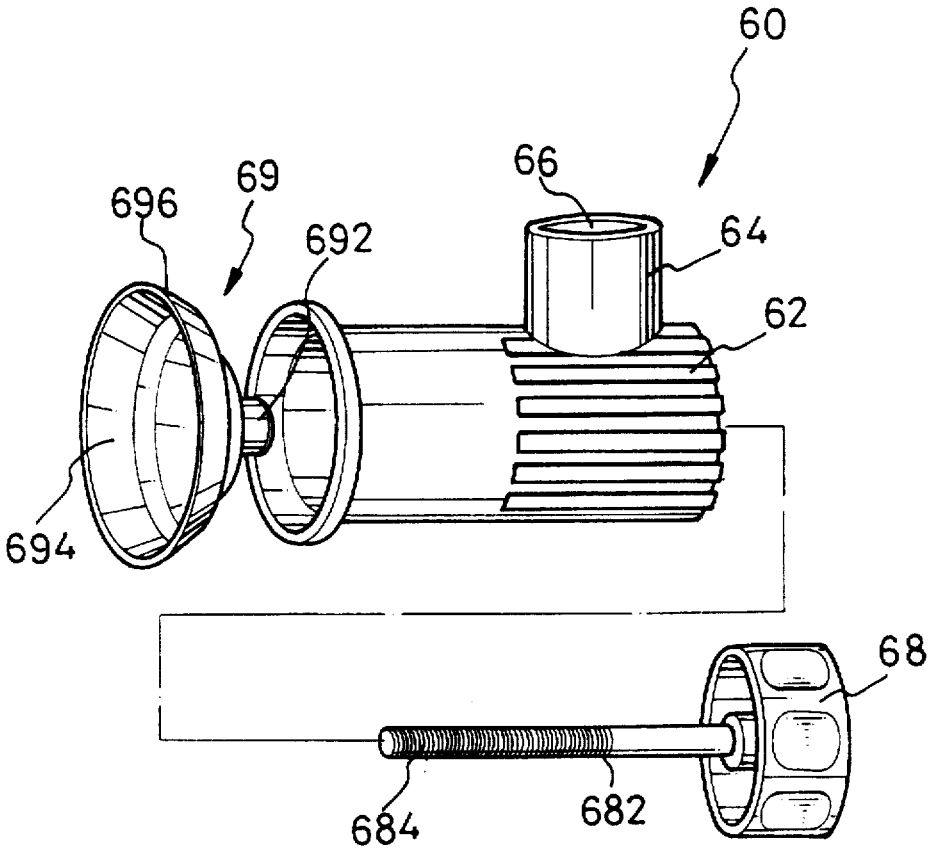
FIG. 3 is a perspective exploded view, in an enlarged scale, showing a vacuum mounting device in accordance with the present invention.

Referring to FIG. 3, the vacuum mounting device 60 consists of a housing 62, a radially extending portion 64 integrally formed with the housing 62 and defining a socket 66 for receiving the bottom end of the post 56, a knob 68 fixedly connected with a rod 682 defining a threaded portion 684 on a front end thereof, and a sucker 69 having a rear protrusion 692 fixedly connected with a front edge of the rod 682. The rear protrusion 692 can be fixedly connected with the front edge of the rod 682 by a known means. The sucker 69 defines an inside portion 694 and an outside portion 696.

The threaded portion 684 of the rod 682 is threadedly engaged with a passage (not shown) defined in the housing 62. The passage defined thread on its surface. When the knob 68 is turned, the rod 682 can have a linear movement in relation to the housing 62 so that sucker 69 can also have a linear movement in relation to the housing 62.

Returning to FIG. 1, when the bottom end of the post 56 is intended to be mounted on the wall 44, the vacuum mounting device 60 is brought to a position in which the sucker 69 is contacted with a surface of the wall 44. Then, the knob 68 is turned to push the sucker 69 toward the wall 44 a predetermined distance whereby air existed between the wall 44 and the inside portion 694 (FIG. 3) of the sucker 69 is forced to flow out of the sucker 69 thereby to create a vacuum in the sucker 69 while the outside portion 696 (FIG. 3) of the sucker 69 is subjected to an atmospheric pressure. Thus, the vacuum mounting device 60 can attach the bottom end of the post 56 to the wall 44 by a vacuum pressure acting on the sucker 69.

Figure 4:
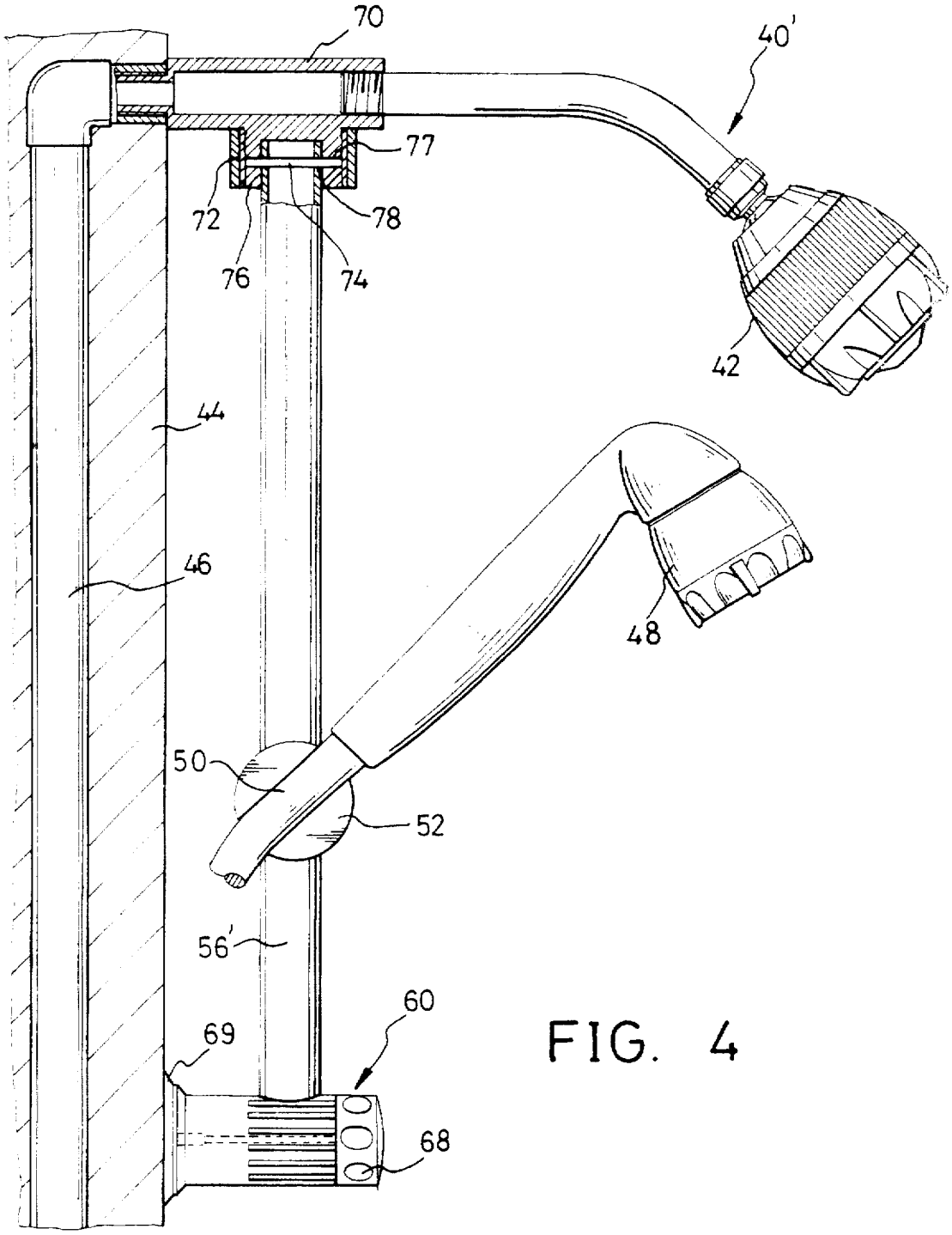
FIG. 4 is a view similar to FIG. 1, but showing an alternative embodiment of the invention.

FIG. 4 shows an alternative embodiment of the present invention. The embodiment as shown in FIG. 4 is related to modify the connection between the top end of the post 56 and the fitting 47 as shown in FIG. 1. In this embodiment, the present invention discloses a shower attachment 40' having a post 56' whose top end is connected to a fitting 70 by the following manner, in which the fitting 70 is used to attach the fixed shower head.

Like the fitting 47 as shown in FIG. 1, the fitting 70 of the alternative embodiment is also integrally formed with a radially extending portion 76. However, this radially extending portion 76 defines an inner recess having a smooth surface and an outer periphery having thread thereon. A first lateral hole 77 is defined through the radially extending portion 76. The top end of the post 56' is defined with a second lateral hole 78.

When the top end of the post 56' is intended to be mounted onto the fitting 70, firstly a sleeve 72, which has a thread defined on its inner periphery, is brought to pass downwardly through a top portion of the post 56' until the sleeve 72 is rested on the bracket 52 and around the post 56'. Then, the top end of the post 56' is inserted into the inner recess defined by the radially extending portion 76 to a position in which the second hole 78 is aligned with the first hole 77. Thereafter, a pin 74 is forced to extend through the radially extending portion 76 and the top end of the post 56' respectively via the first and second holes 77 and 78, thereby to fixedly connect the post 56' and the fitting 70 together. Finally, the sleeve 72 is brought upwardly to mate its inner thread with the thread defined on the outer periphery of the radially extending portion 76 of the fitting 70 as shown by FIG. 4, thereby to hide the pin 74 from sight.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A mounting assembly for mounting a bracket for attaching a hand-held shower head in relation to a wall of a bathroom, comprising:

a fitting having a first end adapted to be connected with a fixed spray head, a second end adapted to be connected to a water supply pipe and a first extending portion;

a post adapted to allow a bracket for attaching a hand-held shower head to be slidably locked therealong, said post comprising a first end for fixedly connecting with the first extending portion and a second end; and a vacuum mounting device attached on the second end of said post for mounting the second end of said post on a flat surface with a vacuum pressure, said vacuum mounting device comprising a housing, a second extending portion integrally formed with the housing for receiving the second end of said post, a sucker linearly movably mounted on said housing and a sucker controlling means rotatably mounted on said housing and connected with said sucker for controlling the linear movement of said sucker in relation to said housing, wherein said sucker controlling means comprises a rod threadedly engaged with said housing, said rod having a first end fixedly connected with said sucker and a second end fixedly connected with a knob.

2. A mounting assembly for mounting a bracket for attaching a hand-held shower head in relation to a wall of a bathroom, comprising:

a fitting having a first end adapted to be connected with a fixed spray bead, a second end adapted to be connected to a water supply pipe and a first extending portion;

a post adapted to allow a bracket for attaching hand-held shower head to be slidably locked therealong, said post comprising a first end for fixedly connecting with said first extending portion and a second end, wherein said first end is fixedly connected with said first extending portion by extending a pin through said first end and said first extending portion; and a vacuum mounting device attached on said second end of said post for mounting said second end of said post on a flat surface with a vacuum pressure.

3. The mounting assembly in accordance with claim 2 further comprising a sleeve attached to an outer periphery of said first extending portion for concealing said pin.

* * * * *